US009085392B2

(12) United States Patent
Reichert et al.

(10) Patent No.: US 9,085,392 B2
(45) Date of Patent: Jul. 21, 2015

(54) METHOD AND DEVICE FOR PRODUCING A PACKAGING BAG FROM FLEXIBLE FILM MATERIAL AND STIFFENED PARTIAL REGION AND PACKAGING BAG

(75) Inventors: Manfred Reichert, Remshalden (DE); Bernd Wilke, Leutenbach (DE); Ulrich Wieduwilt, Schwaebisch Gmuend (DE); Detlev D. Ansinn, Bridgman, MI (US)

(73) Assignee: Robert Bosch GmbH, Stuttgart (DE)

( * ) Notice: Subject to any disclaimer, the term of this patent is extended or adjusted under 35 U.S.C. 154(b) by 270 days.

(21) Appl. No.: 13/509,013

(22) PCT Filed: Oct. 5, 2010

(86) PCT No.: PCT/EP2010/064846

§ 371 (c)(1),
(2), (4) Date: May 10, 2012

(87) PCT Pub. No.: WO2011/057866

PCT Pub. Date: May 19, 2011

(65) Prior Publication Data

US 2012/0230614 A1 Sep. 13, 2012

(30) Foreign Application Priority Data

Nov. 16, 2009 (DE) ..... 10 2009 046 717

(51) Int. Cl.
*B31B 1/60* (2006.01)
*B65D 33/02* (2006.01)
(Continued)

(52) U.S. Cl.
CPC ..... *B65D 33/02* (2013.01); *B65B 9/207* (2013.01); *B65B 9/213* (2013.01); *B65B 9/22* (2013.01); *B65B 61/00* (2013.01); *B65D 75/52* (2013.01); *B65B 9/2056* (2013.01)

(58) Field of Classification Search
USPC ..... 493/220, 217, 148, 292; 53/551, 554, 53/451
See application file for complete search history.

(56) References Cited

U.S. PATENT DOCUMENTS 2,213,290 A * 9/1940 Rowe ..... 156/171
2,259,866 A * 10/1941 Stokes ..... 53/415
(Continued)

FOREIGN PATENT DOCUMENTS

CN 101370713 2/2009
DE 1167002 4/1964
(Continued)

OTHER PUBLICATIONS

PCT/EP2010/064846 International Search Report.

*Primary Examiner* — Sameh Tawfik
(74) *Attorney, Agent, or Firm* — Michael Best & Friedrich LLP

(57) ABSTRACT

The invention relates to a method for producing a packaging bag from a flexible film material (2) comprising the following steps: feeding of the flexible film material (2); adding an additional material (7) to the flexible film material (2) and producing at least one stiffened partial region (6) from the additional material (7), wherein the additional material (7) is hardened and forms the stiffened partial region (6). The invention further relates to a device for producing a packaging bag, comprising: a film feeding device (10) for feeding flexible film material (2) and an additional material adding device (11) for adding an additional material (7). The invention further relates to a packaging bag (5) comprising: a first transverse seal seam (14), a second transverse seal seam (15), a flexible partial region (16) and at least one stiffened partial region (6), wherein the flexible partial region (16) is produced from the film material (2) and the stiffened partial region (6) is produced from an additional material (7) which was added and hardened to stiffen the packaging bag.

7 Claims, 5 Drawing Sheets

(51) Int. Cl.

| | |
|---|---|
| ***B65B 9/207*** | (2012.01) |
| ***B65B 9/213*** | (2012.01) |
| ***B65B 9/22*** | (2006.01) |
| ***B65B 61/00*** | (2006.01) |
| ***B65D 75/52*** | (2006.01) |
| *B65B 9/20* | (2012.01) |

(56) References Cited

U.S. PATENT DOCUMENTS

| | | | | | |
|---|---|---|---|---|---|
| 2,605,040 | A | * | 7/1952 | Belcher | 383/33 |
| 3,084,984 | A | * | 4/1963 | Adler | 312/31 |
| 3,515,621 | A | * | 6/1970 | Watson | 428/108 |
| 3,690,221 | A | | 9/1972 | Schmedding | |
| 3,741,253 | A | * | 6/1973 | Brax et al. | 138/137 |
| 3,788,199 | A | * | 1/1974 | Sato et al. | 493/196 |
| 3,809,230 | A | * | 5/1974 | Poncy | 206/306 |
| 4,257,316 | A | * | 3/1981 | Roder et al. | 493/68 |
| 4,428,788 | A | * | 1/1984 | Kamp | 156/66 |
| 4,741,789 | A | * | 5/1988 | Zieke et al. | 156/66 |
| 5,707,329 | A | | 1/1998 | Pool et al. | |
| 5,804,265 | A | * | 9/1998 | Saad et al. | 428/35.2 |
| 6,032,437 | A | | 3/2000 | Bois | |
| 6,296,886 | B1 | | 10/2001 | DePoorter et al. | |
| 6,589,147 | B2 | * | 7/2003 | Dominguez et al. | 493/269 |
| 7,000,366 | B2 | | 2/2006 | Borghi et al. | |
| 7,059,099 | B2 | | 6/2006 | Ausnit | |
| 7,699,002 | B2 | | 4/2010 | Utz et al. | |
| 2003/0163979 | A1 | | 9/2003 | Kurth et al. | |
| 2005/0252175 | A1 | | 11/2005 | Martin | |
| 2009/0035496 | A1 | | 2/2009 | Nakagawa et al. | |

FOREIGN PATENT DOCUMENTS

| | | |
|---|---|---|
| DE | 2130133 | 12/1972 |
| DE | 10121526 | 11/2002 |
| DE | 102005002301 | 7/2006 |

* cited by examiner

METHOD AND DEVICE FOR PRODUCING A PACKAGING BAG FROM FLEXIBLE FILM MATERIAL AND STIFFENED PARTIAL REGION AND PACKAGING BAG

BACKGROUND OF THE INVENTION

The present invention relates to a method and a device for producing a tubular packaging bag from a flexible film material and to a packaging bag.

Tubular packaging bags that receive liquid or solid charges, and that are generally produced and filled by means of horizontal or vertical tubular bag machines, are known in various designs from the prior art. However, these packaging bags made of flexible film material have the disadvantage that, despite for example having their edges embossed at the corners of the bags, the material from which they are made means they do not have any dimensional stability. Accordingly, these packages, particularly when thin films are used, have relatively limp bags, resulting in poor haptics. To protect their contents, these packages also have to be transported and stored in an impact-resistant and compression-resistant outer packaging.

SUMMARY OF THE INVENTION

By contrast, the method according to the invention for producing a packaging bag has the advantage that a packaging bag with a flexible partial region and with a stiffened partial region is produced from a flexible film material. Here, a stiffening of the packaging bag is achieved by means of a flexible film material being delivered in a first method step. Thereafter, in a further method step, an additional material is added to the flexible film material. In a final method step, at least one stiffened partial region is produced from the additional material, the additional material being hardened and forming the stiffened partial region. As a result of the significantly increased stiffness of the packaging bag achieved by the stiffened partial region, it is possible by and large to do without additionally required outer packages for storage and transport, particularly in the case of packaging bags made of flexible film material and containing a liquid or fragile charge. The method for producing a stiffened packaging bag can be performed in an operationally reliable manner and inexpensively on conventional tubular bag machines.

According to a preferred embodiment of the invention, the additional material can be added to an inner face and/or an outer face of the film material. In this way, the haptics or grip of the package can be significantly improved in a simple way and can be individually adapted to the required packaging characteristics, largely without any extra outlay in terms of equipment.

According to the invention, the stiffened partial region has a planar shape and/or a linear shape and/or a lattice structure. It is thus possible to considerably improve the stiffness of the package in a simple and inexpensive manner.

The additional material is preferably hardened by means of heat and/or UV light and/or electron beams or by contact with the ambient air. Depending on the cycle time of the tubular bag machine and/or the production runs required under foodstuffs legislation, the method according to the invention can in this way be adapted to the required type of hardening at no extra time and cost in the production machines used.

The additional material is also preferably added by spraying or rolling. As a result, depending on the type of use, the method according to the invention can be used for producing different packages with the individually required stiffnesses cost-effectively and operationally reliably on the same machine type.

According to another preferred embodiment of the invention, the flexible film material and the additional material can have the same or a different material composition. In this way, it is possible to adapt the method economically, i.e. at optimized time and cost, to the dimensional stability and stiffness properties of the package that is to be produced. Moreover, the additional material is added in the region of a forming shoulder or in the region of a forming tube of a tubular bag machine.

The invention further relates to a device for producing a packaging bag, which device comprises a film-feeding device for delivering flexible film material, and an additional-material adding device for adding an additional material. It is possible to arrange the additional-material adding device exchangeably, such that it is possible to switch quickly to another stiffening pattern during production.

The device according to the invention also preferably comprises a hardening device for hardening the added additional material. It is possible by and large to use the same tried-and-tested and energy-efficient technique as for sealing the bottom seam and head seam of the tubular bag, without any great additional machine outlay.

The additional-material adding device is also preferably arranged in the region of the forming shoulder, and a large number of openings through which the additional material is introduced are provided, particularly in the forming shoulder. By virtue of the fact that the additional material is introduced at a very early stage, i.e. during the forming of the tubular bag, the stiffened partial region of the film material can be produced by hardening likewise taking place in the region of the forming shoulder during the forming and prior to the longitudinal sealing of the film tube.

According to another preferred embodiment of the invention, the additional-material adding device is arranged in the region of the forming tube. By means of the additional material being introduced only in the region of the forming tube and then hardened, it is possible for the stiffened partial region to be produced on the already formed film tube. This is advantageous particularly in the case of thinner, more sensitive film materials or in the case of a greater layer thickness of the additional material introduced.

The invention further relates to a packaging bag made of a flexible film material, which packaging bag comprises a first transverse sealing seam, a second transverse sealing seam, a longitudinal sealing seam, at least one flexible partial region, and at least one stiffened partial region. The flexible partial region is produced from the film material, and the stiffened partial region is produced from an additional material which is added and hardened to stiffen the packaging bag. In this way, a packaging bag with a new kind of haptics is produced, wherein the stiffened partial region ensures sufficient stiffness and stability of the packaging bag. The packaging bag according to the invention can be produced inexpensively on known machines, with very few additional devices being required. According to the invention, the stiffened partial region allows a particularly thin film to be used.

The at least one stiffened partial region is particularly preferably arranged on an inner face and/or outer face of the film material, resulting in an improved haptic detection by the user and also in a significantly increased stiffness and dimensional stability of the packaging bag.

The at least one stiffened partial region of the packaging bag according to the invention preferably has a planar shape and/or a linear shape and/or a lattice structure. In this way, it is possible, depending on the intended use, to stiffen the packaging bag by means of the additional material both in the longitudinal direction and also in the transverse direction of the film tube with minimum outlay in time and cost, as a result of which predetermined packaging bags with the desired dimensional stability and haptic properties can be produced.

Moreover, the stiffened partial region has such a structure that the latter forms a stable holding structure, so that the packaging bag stands independently. In this way, uniform stiffening of the entire package can be achieved with minimum outlay in terms of time and cost of production.

BRIEF DESCRIPTION OF THE DRAWINGS

Preferred illustrative embodiments of the invention are described in detail below with reference to the attached drawing, in which.

DETAILED DESCRIPTION

A device 1 according to the invention is described in detail below with reference to FIGS. 1 to 4 in a first illustrative embodiment of the invention.

Figure 1:
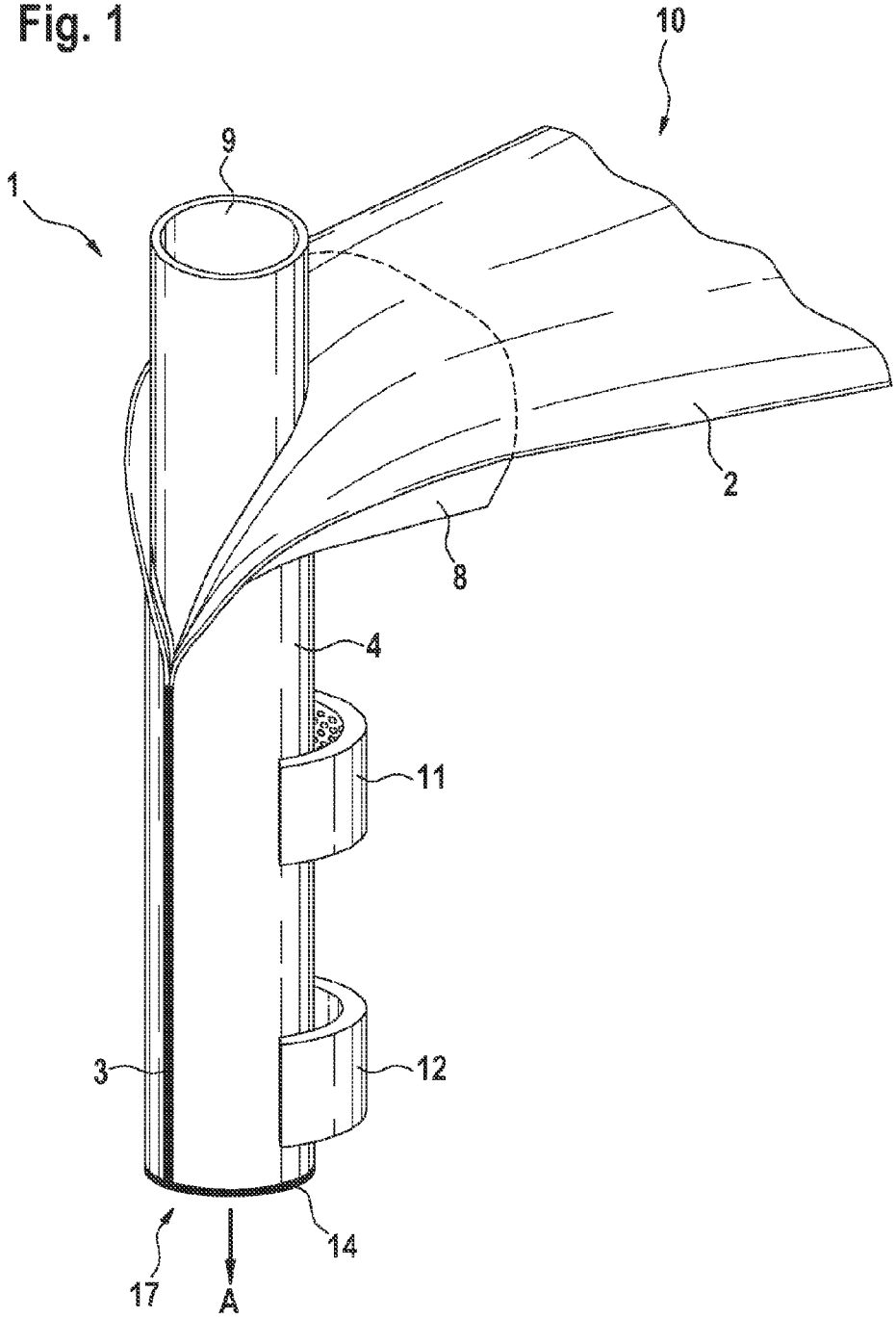
FIG. 1 shows a perspective view of part of a machine for producing the packaging bag according to a first embodiment of the device according to the invention.

FIG. 1 shows a perspective view of part of a machine for producing the packaging bag according to a first embodiment of the device according to the invention. As can be seen from FIG. 1, the device 1 for producing a packaging bag comprises a film-feeding device 10 (shown only schematically) by means of which a flexible film material 2 is fed, and an additional-material adding device 11, which in this illustrative embodiment is arranged on a forming tube 9 of the device 1 and through which an additional material 7 (see FIG. 2) is added to the flexible film material 2. A longitudinal sealing device (not shown in this figure) seals the film material 2, with a longitudinal sealing seam 3, around the forming tube 9 in order to form an elongate film tube 4. As can also be seen from FIG. 1, the film tube 4 moreover has a first transverse sealing seam (bottom seam) 14, which is provided at a lower end 17 of the film tube 4 by a transverse sealing device (not shown here).

Figure 2:
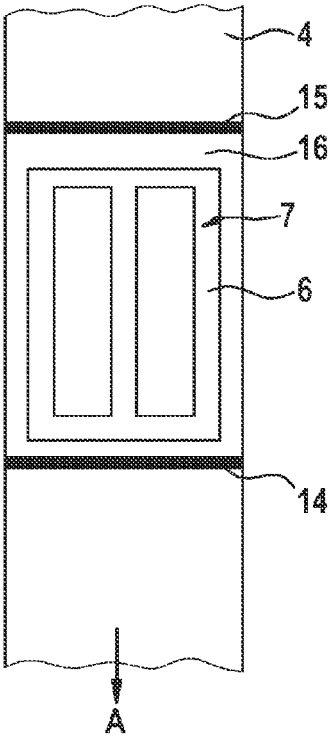
FIG. 2 shows a schematic front view of a film tube from FIG. 1.

As can be seen from FIG. 2, which shows a schematic front view of the film tube 4 according to the first illustrative embodiment in FIG. 1, the additional material 7 added is used to form a stiffened partial region 6 applied in a desired pattern in a flexible partial region 16 of the film tube 4 between the first transverse sealing seam 14 (bottom seam) and a second transverse sealing seam 15 (head seam). It will be noted here that the stiffened partial region 6 can have any desired planar shape and/or linear shape and/or a lattice structure and can be applied not only on a front face or about a partial circumference of the film tube, as shown in FIG. 2, but also about the entire circumference of the film tube.

Figure 3:
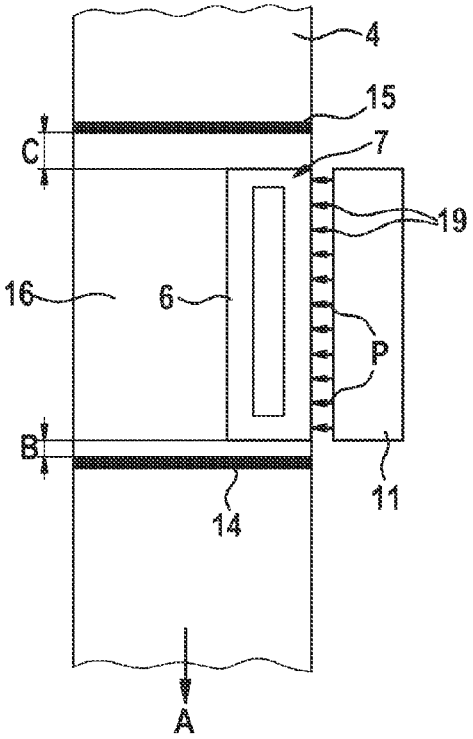
FIG. 3 shows a schematic side view of the film tube from FIG. 2.

As is shown in the schematic side view in FIG. 3, the additional-material adding device 11 adds the additional material 7 for the stiffened partial region 6 via the large number of openings, of which two are indicated by way of example by reference number 19. This adding or applying procedure is symbolized in FIG. 3 by arrows P. It will be noted here that the additional material 7 is applied while the film material 2 is stationary. Moreover, in a feeding direction of the film tube 4 as indicated by an arrow A, each stiffened partial region 6 is at a predetermined distance B from the first transverse sealing seam 14 and at a predetermined distance C from the second transverse sealing seam 15, so as not to interfere with the sealing action of the bottom seam and head seam.

Furthermore, the device 1 shown in FIG. 1 has a hardening device 12 which, with respect to the feed direction A of the film material 2, is arranged on the forming tube 9 at a location downstream of the additional-material adding device 11. The additional-material adding device 11 and the hardening device 12 are shown only in part in the view in FIG. 1. It will be noted here that, for the additional material, only those materials are used that can be easily processed by the provided additional-material adding device 11 (preferably as spraying system) and that contain substances (e.g. sensitizers) that harden after application. Moreover, the materials used also have the properties required legally for foodstuffs, so as to be able to be processed on said packaging machines.

In a first method step, the method according to the invention for producing the packaging bag 1 from flexible film material 2 delivers the flexible film material 2, which is shaped around the forming tube 9 via the forming shoulder 8 and is sealed by the longitudinal sealing seam 3 to form the film tube 4. This state is illustrated in detail in the view in FIG. 1.

In a second method step, the additional material 7 is applied to the flexible film material 2 by an additional-material adding device 11. The additional material 7 is in this case sprayed on in any desired pattern, which can have a planar shape and/or a linear shape and/or a lattice structure and which, depending on the type of use, extends about a part or all of the circumference of the film tube 4. The additional material is applied to a stationary film tube.

In a subsequent third method step, at least one stiffened region 6 is produced from the added additional material 7, by means of the additional material 7 being hardened preferably by heat or UV light or electron beams. For this purpose, the film tube 4 is moved a short distance in the direction of the arrow A. At the same time as or after this third method step, the first transverse sealing seam (bottom seam) 14 is produced at the lower end 17 of the film tube 4. It will be noted here that, between the first transverse sealing seam 14 and the stiffened partial region 6, the distance B (see FIG. 3) is provided so as not to adversely affect the quality of the sealing action of the bottom seam 14.

After the semi-finished packaging bag 1 has been filled via the hollow cylindrical forming tube 9, the second transverse sealing seam 15 (head seam) is finally produced on the film tube 4 and the packaging bag 5 is thus closed. When producing the second transverse sealing seam 15, the first transverse sealing seam of a further packaging bag 5 to be produced subsequently can also preferably be produced at the same time. It will be noted here that, between the second transverse sealing seam 15 and the stiffened partial region 6, the distance C is provided (see FIG. 3) so as not to adversely affect the quality of the sealing action of the head seam 15.

Figure 4:
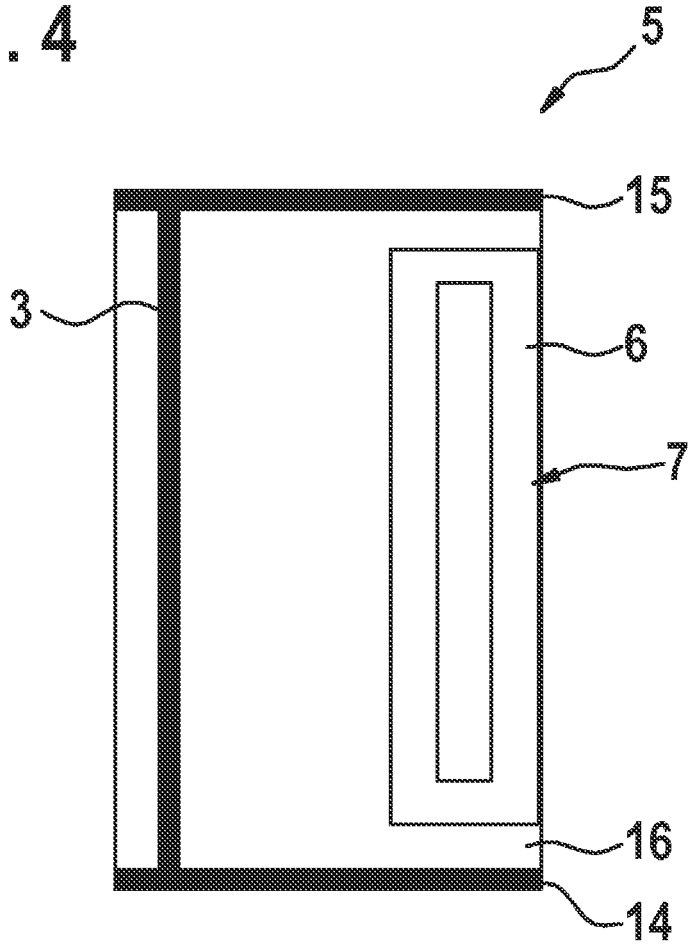
FIG. 4 shows a schematic side view of a stiffened packaging bag produced according to the first embodiment.

FIG. 4 shows a schematic side view of a completed and filled packaging bag 5 that has been separated from the film tube 4. As will be seen from FIG. 4, the packaging bag 5 comprises the longitudinal sealing seam 3, the first transverse sealing seam 14, the second transverse sealing seam 15, the flexible partial region 16, and the stiffened partial region 6 which, by way of example, has the form of a double frame here. The flexible partial region 16 is produced from the film material 2, and the stiffened partial region 6 is produced from the additional material 7 that was added and hardened in order to stiffen the packaging bag 5.

The packaging bag 5 according to the invention has in particular the advantage that the structure of the stiffened partial region 6 can be chosen, depending on the intended use of the packaging bag 5, such that it provides so stable a holding structure that the packaging bag 5 stands independently because of its high degree of stiffness and its dimensional stability. In this way the packaging bag, particularly for fragile or liquid contents, can be configured such that it is possible to do without the impact-resistant and compression-resistant outer packaging previously required to protect the contents. In addition, such packaging bags can be arranged standing in a very stable position in shipping boxes and presentation displays.

In the packaging bag according to the invention, the improved stiffness and dimensional stability of the packaging bag is also obtained using only a comparatively small amount of the additional material, which contributes to the low overall costs of the packaging. The novel method of producing partially stiffened packaging bags from the flexible film material with stiffened partial regions can be performed in an operationally reliable manner and can even be subsequently integrated in existing vertical and horizontal tubular bag machines.

A second illustrative embodiment of the device according to the invention for producing the packaging bag is described below with reference to FIGS. 5 and 6, where identical parts are designated by the same reference numbers as in the first illustrative embodiment. The second illustrative embodiment shown in FIGS. 5 and 6 differs from the above-described first illustrative embodiment in that the additional-material adding device 11 are arranged on the forming shoulder 8 of the device 1. As can be seen from FIG. 5, the film material 2 is fed across the forming shoulder 8, in which a large number of openings 13 are formed through which, during an advance cycle of the film material 2, the additional material 7 is applied from the additional-material adding device 11 via a delivery line 20 connected to each opening 13. As can be seen more clearly from FIG. 6, several of these openings 13 in the forming shoulder 8 are provided about the entire circumference at a transition region 18 between the forming shoulder 8 and the forming tube 9. The already sealed longitudinal sealing seam 3 can also be seen in the plan view in FIG. 6. It will be noted here that, in order to simplify the view, the delivery lines 20 are not illustrated in FIG. 6.

Figure 5:
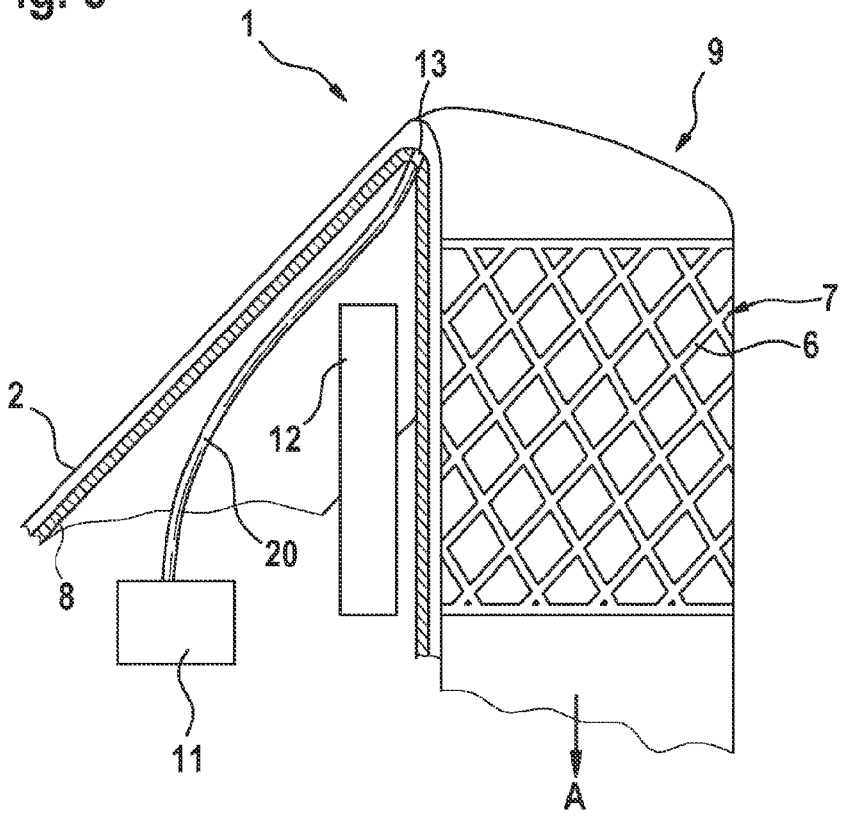
FIG. 5 shows a schematic side view of a device for producing the packaging bag according to a second embodiment.
Figure 6:
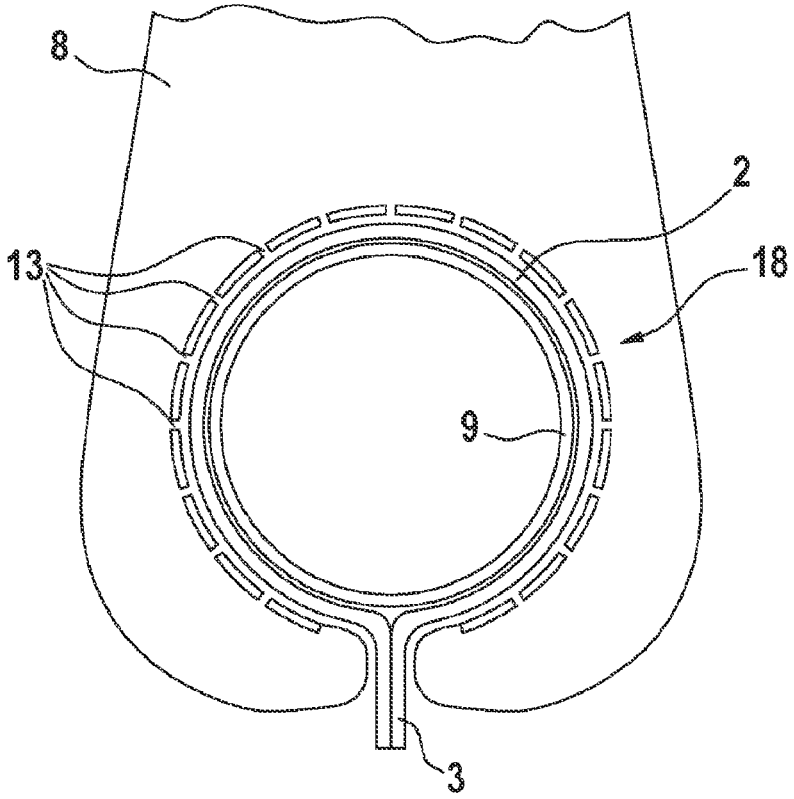
FIG. 6 shows a schematic plan view of the device from FIG. 5.

As can also be seen from FIG. 5, the additional material 7, sprayed by the additional-material adding device 11 onto the flexible film material 2 through the large number of openings 13 (spray nozzles), hardens and forms the stiffened partial region 6, which is here shown as a lattice structure for example. By means of the additional-material adding device 11 being positioned on the forming shoulder 8, linear structures and/or lattice structures can preferably be applied as stiffened partial regions to the film material 2 as the latter moves past.

What is claimed is:

1. A method for producing a packaging bag from a flexible film material (2), the method comprising:

a) feeding the flexible film material (2) across a forming shoulder (8) that shapes the flexible film material (2);

b) spraying an additional material (7) onto the flexible film material (2) through a plurality of openings (13) that are in the forming shoulder (8), and c) producing at least one stiffened partial region (6) from the additional material (7), wherein the additional material (7) is hardened and forms the stiffened partial region (6).

2. The method as claimed in claim 1, characterized in that the additional material (7) is added to at least one of an inner and an outer face of the film material (2).

3. The method as claimed in claim 1, characterized in that the stiffened partial region (6) has at least one of a planar shape, a linear shape, and a lattice structure.

4. The method as claimed in claim 1, characterized in that the additional material (7) is hardened by heat or UV light or electron beams or by contact with the ambient air.

5. The method as claimed in claim 1, characterized in that the flexible film material (2) and the additional material (7) have the same material composition.

6. The method as claimed in claim 1, characterized in that the additional material (7) is added in a region of a forming shoulder (8) or in a region of a forming tube (9).

7. The method as claimed in claim 1, characterized in that the flexible film material (2) and the additional material (7) have a different material composition.

* * * * *